United States Patent [19]

Kalus et al.

[11] Patent Number: 4,572,855

[45] Date of Patent: Feb. 25, 1986

[54] LABEL TAPE

[75] Inventors: Peter Kalus, Neckargemünd; Gerhard Wippern, Hirschhorn-Langental, both of Fed. Rep. of Germany

[73] Assignee: Esselte Pendaflex Corporation, Garden City, N.Y.

[21] Appl. No.: 534,705

[22] Filed: Sep. 22, 1983

[30] Foreign Application Priority Data

Sep. 30, 1982 [DE] Fed. Rep. of Germany ... 8227503[U]

[51] Int. Cl.[4] ..... B65D 65/28; G09F 3/00

[52] U.S. Cl. ..... 428/43; 428/40; 428/41; 428/42; 428/137; 428/138; 428/512; 428/513; 428/514; 428/537; 40/2 R

[58] Field of Search ..... 40/2 R; 428/137, 513, 428/514, 537, 40, 41, 42, 43, 512

[56] References Cited

U.S. PATENT DOCUMENTS 4,254,173 3/1981 Peer, Jr. ..... 428/512

4,425,394 1/1984 Jenkins ..... 40/2 R

*Primary Examiner*—Joseph L. Schofer

*Assistant Examiner*—J. M. Reddick

*Attorney, Agent, or Firm*—Murray, Whisenhunt & Ferguson

[57] ABSTRACT

The invention relates to a label tape of successive individual labels which are to be appended to articles for sale and which are separated from one another by separating cuts extending transversely with respect to the tape length direction, said tape consisting of a carrier layer formed of polyethylene film and of a printable paper layer firmly bonded to said film.

4 Claims, 2 Drawing Figures

LABEL TAPE

The invention relates to a label tape of successive individual labels which are to be appended to articles for sale and which are separated by separating cuts extending transversely of the tape length direction.

In department stores, supermarkets and the like it is customary to provide the individual articles offered for sale with labels having the prices printed thereon. Frequently the labels are directly adhered to the articles. For this type of label special hand labelling devices are available by means of which the label can be printed with the respective price and then adhered to the article. For these hand labelling devices a label tape is used which consists of a continuous carrier tape and of individual labels provided thereon which are separated from one another by separating cuts. In the hand labelling device one label each is printed and drawn by advancing means about a dispensing edge where it separates from the carrier tape so that it arrives at a dispensing position below a pressure roll. The label can then be adhered to the article by rolling said roll over the article. However, this type of label is suited only for articles to which it can be fastened directly by adhesion.

In case of textiles it is not possible to affix price labels by adhesion. Therefore price tags are used for textiles which normally consist of cardboard and are attached to textiles by a hanger. The hanger consists of a plastic wire having an enlarged head portion from which a thin shaft extends having a crossbar at its opposite end which is capable of being folded over. For affixing these cardboard tags the crossbar is folded into a position parallel to the shaft and pushed through a hole in the tag and into the fabric of the textile article whereupon the crossbar anchors the hanger in the textile article in the manner of a barb. The enlarged head portion is larger than the hole in the cardboard tag so that the tag is safely secured to the textile article. For this type of labels special printing devices are required by which the price can be printed on the label. This implies that in department stores different types of label printers must be available depending on the type of goods to be labelled.

The object of the invention is the provision of a label tape which can be printed in the hand labelling devices hitherto used for printing and attaching adhesive labels, and the individual labels of which can be affixed to textiles.

According to the invention, this object is realized in that the tape consists of a carrier layer formed of polyethylene film and of a printable paper sheet firmly bonded to said film.

In the label tape of the invention, the carrier layer and the paper layer are inseparably bonded one to the other so that, unlike in the hitherto used label tapes provided with adhesive labels, the paper does not separate from the carrier layer. Instead the paper layer and the carrier layer remain bonded together, which implies that the label tape is only printed in the hand labelling device, and after the label tape has left the device the printed labels are severed from one another at the separating cuts and can then be individually affixed to textile articles. The polyethylene film employed as carrier layer imparts the necessary strength to the label in order that the tape can be safely transported through the hand labelling device to be printed therein without tearing. On the other hand, owing to the separating cuts it can be readily torn off by hand in order to separate the individual labels.

In a favorable further embodiment of the invention, it is contemplated to make the paper sheet from standard OCR paper. A flap cut into the label permits the insertion of a hanger of the type described in more detail above by means of which the label can be affixed to textile articles.

An example of the invention will now be explained in more detail with reference to the drawing in which.

Figure 1:
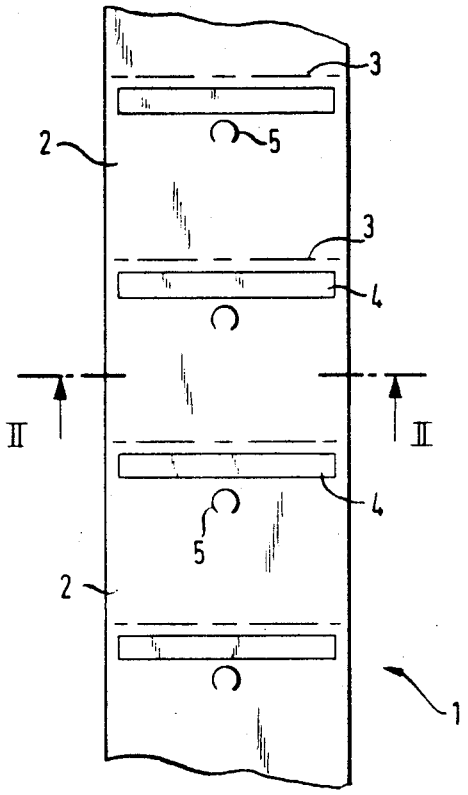
FIG. 1 shows a portion of the label tape of the invention.

The label tape 1 shown in the drawing bears a plurality of identical individual labels 2 arranged one after the other which are separated from each other by separating cuts 3 extending transversely with respect to the tape length. These separating cuts permit separation of the individual labels from each other after they have been printed in a conventional hand labelling device, and at the same time they serve as means for engagement of the tape advancing means used in such a conventional device. A labelling device in which the label tape presently described may be employed is shown and described, for example, in German Patent Application No. 30 30 138.

According to FIG. 1, a printing area 4 may be provided on each individual label 2 on which the name of the store is printed, for example.

Each individual label is provided with a flap 5 formed by an arcuate cut not completely closed to a circle. Through the hole opened by flap 5 a hanger can be pushed by means of which the label can be affixed to a textile structure.

Figure 2:
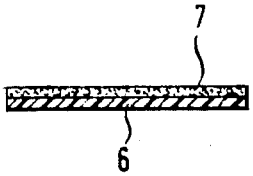
FIG. 2 shows a section through the label tape along the line II—II in FIG. 1.

The section of FIG. 2 shows the structure of the label tape. To the carrier layer 6 consisting of polyethylene film a paper layer 7 is firmly bonded which consists of a readily printable paper, e.g., of OCR paper. The flaps 5 made in the labels 2 extend through both layers 6 and 7. Generally, the film material may be selected from the group consisting of halogenated and non-halogenated polyalkylene and polyvinylhalogenide polymers and mixtures thereof. Further, the adhesives which may be used to firmly bond label tape 1 and individual labels 2 are hotmelt adhesives based on synthetic rubber such as polychloroprene rubber, styrenebutadiene rubber or nitrile rubber, each of which may contain plasticizers. OCR paper is the designation for a paper whose surface has good reflectivity and good printing ink receptivity without the risk of ink blotting. These properties are prerequisite for mechanical reading of printed characters by means of optical reading devices. Such OCR paper is used for the adhesive labels offered by the firm Esselte Meto Deutschland GmbH, Hirschhorn, by the name "OCR-Etiketten". In general, any paper on which clear prints can be made can be employed.

The label tape described permits the hand labelling devices hitherto employed for printing and applying adhesive labels to be used also for printing labels that are to be appended rather than adhered to articles.

We claim:

1. A label tape of successive individual labels which are to be appended to articles for sale, said label tape being for use in a hand labelling device in which each label is provided with an imprint and then dispensed from the labelling device, said label tape comprising a carrier layer formed of a film consisting essentially of polyethylene and a printable layer firmly bonded to said film where each label is provided with said imprint on the side of said imprintable paper layer opposite the side thereof bonded to the carrier layer, said labels being separated from one another by separating cuts which extend through both the carrier layer and the printable layer, the separating cuts extending transversely with respect to the tape direction, whereby due to said material of the carrier layer, the label can be safely transported through the hand labelling device without tearing and, due to the separating cuts, each label can be readily torn from the label tape in such a manner that the carrier layer and the paper layer remain bonded together after each label is torn from the label tape.

2. Label tape according to claim 1 characterized in that the paper layer consists of OCR paper.

3. Label tape according to claim 1 characterized in that a flap is cut into each individual label.

4. Label tape according to claim 2 characterized in that a flap is cut into each individual label.

* * * * *